US005685601A

United States Patent [19]

Corriveau

[11] Patent Number: 5,685,601

[45] Date of Patent: Nov. 11, 1997

[54] QUICKLY-FOLDABLE SWING CHAIR

[76] Inventor: Marcel Corriveau, 3727 Severin Ameau, Trois Rivières, Qc, Canada, G8Y 4V4

[21] Appl. No.: 523,157

[22] Filed: Sep. 5, 1995

[51] Int. Cl.[6] ..... A47B 39/00

[52] U.S. Cl. ..... 297/159.1; 297/261.1; 297/260.2; 297/32

[58] Field of Search ..... 5/120, 122; 472/118, 472/119; 297/118, 32, 159.1, 245, 246, 247, 261.1, 261.2, 261.3, 260.2, 157.1, 59, 39, 40, 41

[56] References Cited

U.S. PATENT DOCUMENTS

| | | | |
|---|---|---|---|
| 221,984 | 11/1879 | Travers | 297/245 X |
| 873,381 | 12/1907 | Manahan | 297/247 |
| 890,375 | 6/1908 | Rathbone | 297/245 |
| 908,689 | 1/1909 | McVey | 297/245 X |
| 952,360 | 3/1910 | Rockwell | 297/245 X |
| 3,047,334 | 7/1962 | Vanderminden | 297/39 |
| 5,253,921 | 10/1993 | Baulet | 297/32 |

FOREIGN PATENT DOCUMENTS

| | | | |
|---|---|---|---|
| 197034 | 4/1958 | Austria | 297/159.1 |
| 65681 | 1/1900 | Canada | 155/24 |
| 131543 | 3/1911 | Canada | 155/21 |
| 185378 | 7/1918 | Canada | 155/24 |
| 198652 | 2/1920 | Canada | 155/24 |
| 2219618 | 3/1994 | Canada | C47C 3/02 |
| 935661 | 6/1948 | France | 297/32 |
| 582943 | 10/1958 | Italy | 297/159.1 |
| 32016 | 7/1911 | Sweden | 297/118 |

*Primary Examiner*—Milton Nelson, Jr.
*Attorney, Agent, or Firm*—Antoine H. Gauvin

[57] ABSTRACT

This stackable, quickly-foldable swing chair has a frame to sway to and fro, and at least one chair. Each chair has a pair of front legs and a pair of rear stiles, individually pivotally mounted on a bracket fastened to the frame. Each stile has a flat bottom having an obtuse angle, as defined between the bottom and the rear of a stile. The pivot is spaced from the frame and receiving the front bottom of the stiles for the stiles to rotate from a substantially horizontal to an inclined rear position, being stopped in the horizontal position by the frame and in the inclined position by the flat bottom of the stiles against the frame. The chair is foldable by frontwardly displacing, from an upward position of the stile to a substantially horizontal position laying down the front legs against said frame, the seat against the front leg, and the stiles against said seat, and vice versa said chair being erected by lifting up said stiles until their respective flat bottom rest against the frame and the stiles are bent backward. This swing chair may also comprise a foldable table and a hammock support.

19 Claims, 6 Drawing Sheets

Fig. 7
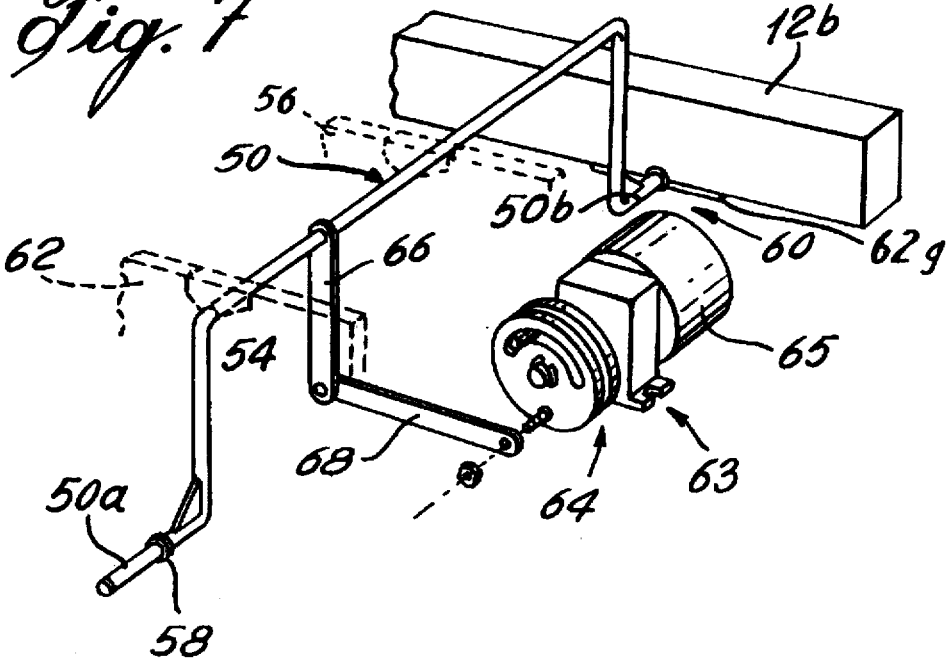
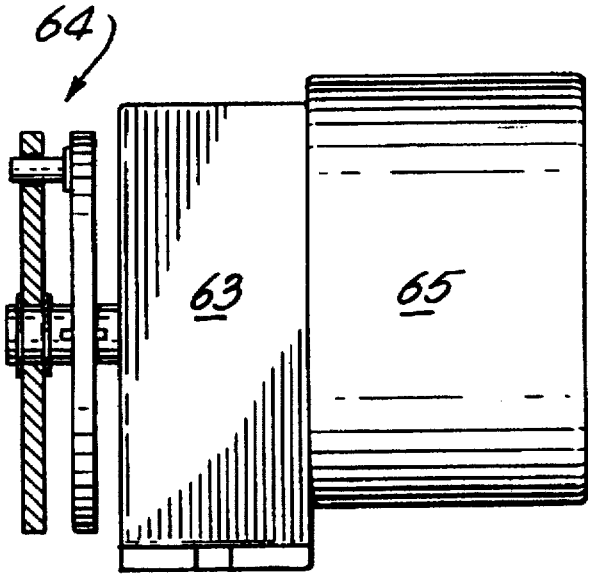
Fig. 8

QUICKLY-FOLDABLE SWING CHAIR

BACKGROUND OF THE INVENTION

1. Field of the Invention

This invention relates to a quickly-foldable swing chair, also referred to as a swing. This invention relates, in a particular embodiment, to a compact swing having a pair of quickly-foldable chairs, a foldable table and a hammock support.

2. Description of Related Art

As is well known in the art, swing chairs generally are not foldable, and in order to store them, one has to generally dismantle them, or are partly foldable and thus requiring ample space.

Swing chairs have been described for instance in:

Canadian Patent 65,681, as filed Oct. 24, 1899, and as invented by M. Lary;

Canadian Patent 131,543, as filed Dec. 15, 1909, and as invented by F. S. Spaulding;

Canadian Patent 185,378, as filed in Apr. 18, 1918, and as invented by U. Hebert;

Canadian Patent 198,652, as filed in May 15, 1919, and as invented by N.Blain;

Canadian Patent 2,119,618, dated Mar. 22, 1994, and as invented by Réal Parent;

U.S. Pat. No. 3,047,334, dated Jul. 31 1962, as invented by Vanderminden; and

U.S. Pat. No. 5,253,921, dated Oct. 19 1993, as invented by Boulet.

None of the above patents is teaching Applicant's invention.

SUMMARY OF THE INVENTION

The quickly-foldable swing chair of the present invention, aims at quickly-folding the chair or chairs found in a swing chair, into a minimum storing space, considering that now-a-day, storage spaces in apartment buildings are limited, and thereby addressing to new situations of the contemporary world.

The quickly-foldable compact swing chair may also have a foldable table which requires no additional spacing, as it is kept for storage, between the chairs and the frame on which the chairs are mounted.

In another particular embodiment, an add-on is also provided as a hammock support.

These quickly-foldable compact swing chairs are also stackable, for instance in warehouses, hotels and the like.

Broadly stated the invention is directed to a quickly-foldable swing chair, where the improvement comprises:

a frame having a pair of parallel sides, spaced one from the other, and said sides of the frame having mounted thereon, at least one chair, each of said chairs defining opposite sides, and having:

a pair of front legs and a pair of rear stiles, each front leg and each stile individually defining a top end and a bottom end opposite thereto, and a front and a rear opposite thereto, and each individually being pivotally mounted about a pivot mounted onto one of said parallel sides, each of said stiles defining a flat bottom end having an obtuse angle, as defined between said bottom end and said rear of a stile, a stopper defined on said parallel sides of said frame, each of said pivots for said stiles receiving a stile, adjacent to said front of said a stile and to said bottom end of said a stile, whereby said stiles rotate from a substantially horizontal to an upwardly, rear inclined, position, being stopped, in said rear inclined position, by said stoppers on said parallel sides of said frame, thus the center of gravity of said chair falling rearwardly in order to obtain a stable equilibrium when in said rear inclined position, a pair of side arms, each arm having one end and another end:

on one of said opposite sides of said chair, one of said side arms being at one end rotatably mounted to one front leg of said pair of front legs, near said top end of said one front leg of said pair of front legs, and said one of said side arms at said another end being rotatably mounted to one stile of said pair of stiles corresponding on the same side of the chair, and on the other of said opposite sides of said chair, the other side arm of said pair of side arms being at one end rotatably mounted to said top end of the other front leg, and said other side arm of said pair of side arms, at said another end, being rotatably mounted to the other stile;

a back bridging said stiles, a seat mounted on a pair of opposite side frames:

each of said side frames for said seat, having one end and opposite thereto, another end, one of said side frames, at said one end, being rotatably mounted to one of said stiles, below said one side arm, and the other side frame at said one end being rotatably mounted to the other of said stiles below said other side arm, and a releasable holding means for holding said side frames of the seat, near said another end, to their corresponding front legs, for a suitable positioning of the seat, when in said upwardly, rear inclined position, whereby said chair is quickly foldable by releasing said releasable holding means for holding said side frames of the seat, and frontwardly bringing down the stiles, from said upwardly, rear inclined, position, to a substantially horizontal position, and thereby said pair of front legs, said seat, and said pair of side arms, and vice versa, said chair is erected by lifting up said stiles until for each of said stiles defining a flat bottom end, their flat bottom end rests against one of said stoppers defined on said parallel sides of said frame, and the stiles reach said upwardly, rear inclined, position, and the seat is locked by actuating said releasable holding means, on each of said opposite sides of said chair, a parallelogram being defined with one of said front legs, one of said stiles, one of said side arms, and the space on said frame as defined between said one of said front legs and said one of said stiles, said back bridging said stiles, thus bridging the parallelogram on each of said opposite sides of said chair, upon folding of the chair, the angles on said parallelograms changing, and correspondingly those of the front legs, and of the stiles with the side frames defining said parallelograms.

By the expression: "substantially horizontal position", throughout the specification, including disclosure and claims, it is meant: "somewhat" and not necessary absolutely. The stiles, moving from said upwardly, rear inclined, position, to be aligned somewhat with the sides, or the longitudinal beams as the case may be, that are in a substantially "horizontal position", In a preferred embodiment, the frame is a rectangular frame having longitudinal and lateral beams jointly mounted as to define a rectangle, said beams defining a top, and said longitudinal beams of the frame, having mounted thereon, said at least one chair, and wherein said front legs and said pair of rear stiles, each individually is pivotally mounted onto one of said longitudinal beams via a bracket.

The invention is also directed to a quickly-foldable swing chair comprising:

in a frame having a means to sway to and fro said frame, said frame having opposite longitudinal beams, and lateral opposite beams there across the longitudinal beams and jointly mounted thereto, said longitudinal beams of the frame having a length, and a top, said longitudinal beams of the frame, having mounted thereon, at least one chair, each of said chairs defining opposite sides, and having:

a pair of front legs and a pair of rear stiles, each front leg and each stile individually defining a top end and a bottom end opposite thereto, and a front and a rear opposite thereto, and at their respective bottom end, each individually being pivotally mounted on a bracket, each of said stiles defining a flat bottom end having an obtuse angle as defined between said bottom end and said rear of a stile, said brackets being fastened to said longitudinal beams of said frame, extending thereabove, and having a pivot, each of said pivots for said stiles receiving one of said stiles, adjacent to said front of said one of said stiles and to said bottom end of said one of said stiles, whereby said stiles rotate from a substantially horizontal to an upwardly, rear inclined position, being stopped by said frame, and in the inclined position by said flat bottom end of said stiles resting against the longitudinal beams of said frame, a pair of side arms, each arm having one end and another end:

on one of said opposite sides of said chair, one of said side arms being at one end rotatably mounted to one front leg of said pair of front legs, near said top end of said one front leg of said pair of front legs, and said one of said side arms at said another end being rotatably mounted to one stile of said pair of stiles corresponding on the same side of the chair, and on the other of said opposite sides of said chair, the other side arm of said pair of side arms being at one end rotatably mounted to said top end of the other front leg, and said other side arm of said pair of side arms, at said another end, being rotatably mounted to the other stile;

a back bridging said stiles, a seat mounted on a pair of opposite side frames:

each of said side frames having one end, and opposite thereto, another end, one of said side frames at said one end being rotatably mounted to one of said stiles, below said one side arm, and the other side frame at said one end, being rotatably mounted to the other of said stiles below said other side arm, and said side frames, near said another end, having each respectively, a slot and at least one notch thereon, for suitable positioning of the seat, and correspondingly each of said front legs having respectively a projecting piece in space relation to one of said slots, in order to enable sliding of one of said slots, along one of said projecting pieces, and be releasably held in one of said at least one notch, of their respective slots, whereby said chair is foldable by releasing said projecting pieces from said notches, and frontwardly bringing down, from an upwardly, rear inclined position of the stiles, to a substantially horizontal position, laying down the front legs against said longitudinal beams of said frame, the seat against the front legs, and the stiles against said seat, and vice versa said chair being erected by lifting up said stiles until their respective flat bottom ends, rest against said longitudinal beams of said frame, and the stiles reaching said upwardly, rear inclined position, and the seat is locked with said projection pieces in said notches, on each of said opposite sides of said chair, a parallelogram being defined with one of said front legs, one of said stiles, one of said side arms, and the space on said longitudinal beams of said frame as defined between said one of said front legs and said one of said stiles, said back bridging said stiles thus bridging the parallelogram on each of said opposite sides of said chair, upon folding of the chair, the angles on said parallelograms changing, and correspondingly those of the front legs, and of the stiles with the side frames defining said parallelograms.

The invention is also directed to such quickly-foldable swing chairs with two chairs being provided:

a chair is positioned near each of said opposite lateral beams of said frame, as to be face-to-face, the length of the stiles are less than half the length of the longitudinal beams of the frame, half of said length of said frame defining the middle of the frame, the stiles are positioned so that on folding, they stop short of said middle of the frame, and said means to sway to and fro said frame consists in:

a cut-off portion in said longitudinal beams of the frame under said chairs, for receiving from a stator having rotatably mounted thereon, a crankshaft with a double crank, each of said cranks ending said crankshaft being rotatably mounted at their one end to a first longitudinal beam of said frame and at the other end to the other longitudinal beam of said frame.

In a preferred embodiment, the stator is a platform having longitudinal sides and lateral sides, and the lateral sides are upwardly projected for receiving thereon, a rotatably mounted crankshaft with a double crank.

The invention is in a particular embodiment, directed to such quickly-foldable swing chairs which further includes a foldable table positionable on said frame between said chairs, said foldable table comprising:

a L-shaped panel having a flat top surface, a bottom surface, a side bearing a short downward extension and an opposite side, said a side bearing a short downward extension, a long leg panel having a given length stopping short of the length between said short downward extension and said opposite side, a short leg panel having a length being substantially that of the long leg panel minus the length of the downward extension, and said short leg panel being hinged to the short downward extension of the L-shaped panel, and said long leg panel being hinged to said bottom surface of said L-shaped panel, near said side opposite to that bearing the downward extension, and removably mounted stretcher bars between each of said leg panels and said L-shaped panel, for maintaining said leg panels perpendicular to said flat top surface, whereby upon removing said stretcher bars, said long leg panel is first foldable over the bottom surface of said L-shaped panel, and then the short leg panel is foldable over said long leg panel, said leg panels being provided with means of fastening them to said frame near said longitudinal beams of said frame.

Further embodiments of the invention will be described herein below.

DESCRIPTION OF THE DRAWINGS

In the drawings which illustrate some of the preferred ways of carrying out the invention.

FIG. 7 is a perspective view of a crank shaft coupled to a motor operated cam-for swinging the chairs;

FIG. 8 is a face view of the motor operating a cam of FIG. 7, except for the outer wheel of the cam which is a cross-section view, taken along a vertical axis of that outer wheel;

Description of some of the preferred ways of carrying out the invention

Figure 1:
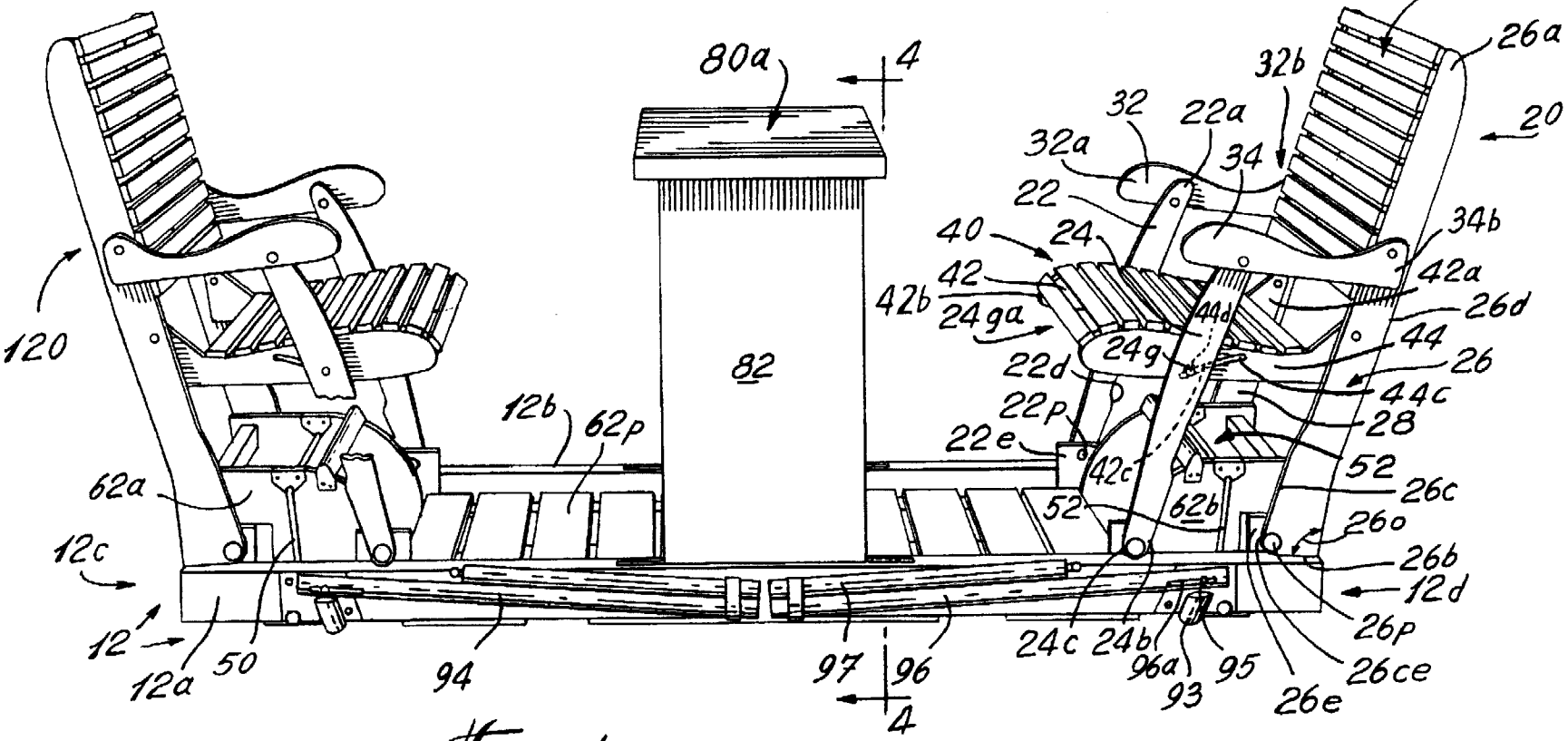
FIG. 1 is a side perspective view of a quickly-foldable swing chair with two chairs and a table in between, all in the upright position, ready for use.
Figure 2:
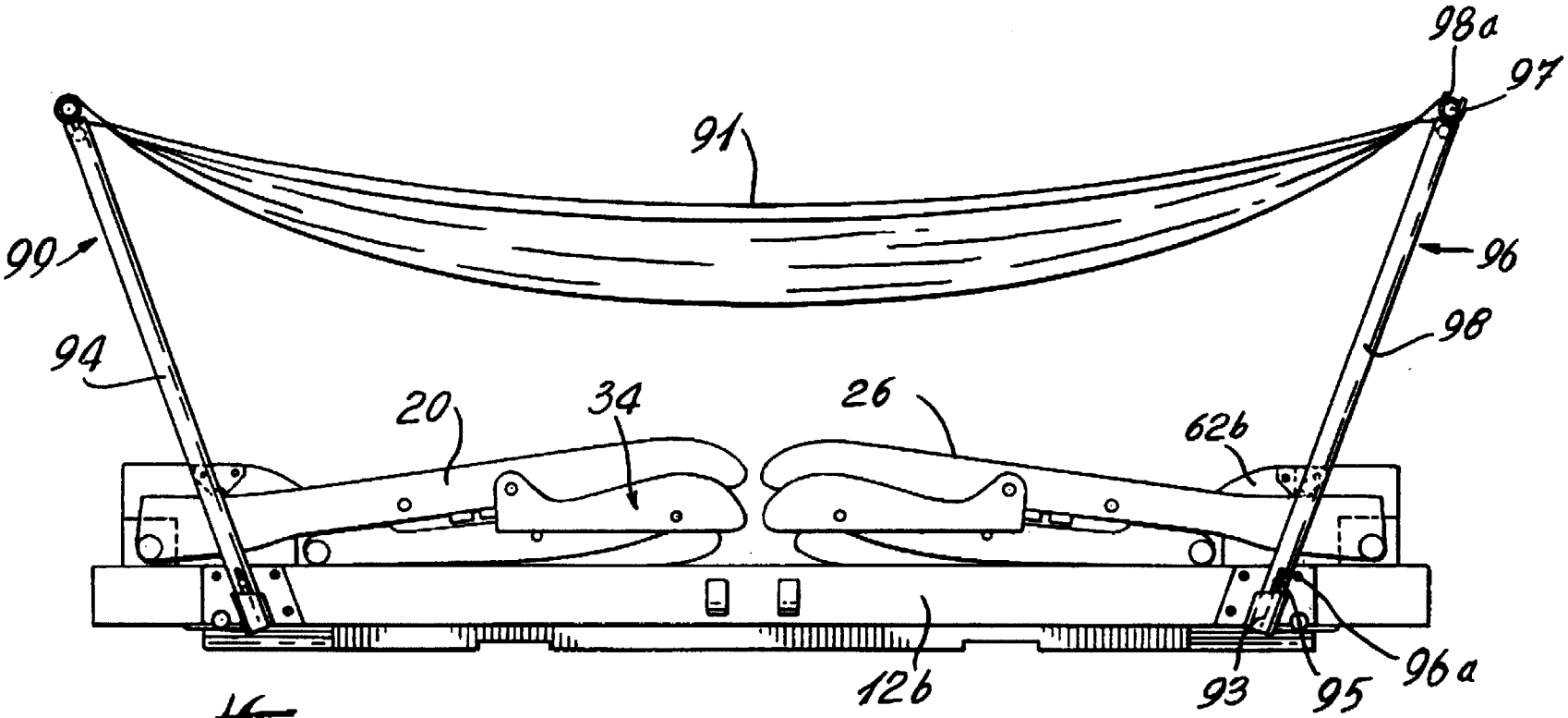
FIG. 2 is a side view of a quickly-foldable swing chair having two folded chairs, and up raised arms for supporting a hammock, the folded chair being laid over a folded table.

As shown in FIGS. 1 and 2, a quickly-foldable swing chair 10 comprises: a frame 12 having a means to sway to and fro that frame, and a pair of parallel beams, such as 12*a*, 12*b*, spaced one from the other, the beams having mounted thereon, at least one chair.

Preferably, the frame is rectangular and has opposite longitudinal beams, 12*a*, 12*b*, and lateral opposite beams 12*c*, 12*d*, there across the lateral beams. The frame has mounted thereon, at least one chair, such as 20 and 120.

In a most preferred embodiment, this is essentially the frame, the frame defining between the beams a rectangular empty space, as will be discussed herein below. These "beams" are "preferably long pieces of heavy timber, used in construction, and long pieces of metal". However, if desired "other supporting members acting as beams" may be used: for instance two opposite sides of a continuous supporting floor, or two opposite sides of a frame, as opposite parallel sides.

Each chair has, and if one selects chair 20:

a pair of front legs 22, 24 and a pair of rear stiles 26, 28. Each leg and each stile, individually defines a top end such as 22*a*, 26*a* and a bottom end opposite thereto, such as 24*b*, 26*b*, and a front such as 24*c* and 26*c*, and a rear opposite thereto such as 22*d* and 26*d*, and each individually being pivotally mounted onto one of the beams, and preferably via a bracket such as 22*e* and 26*e*, at their respective bottom end.

Each of the stiles such as 26, 28 defines a flat bottom such as 26*b*, having an obtuse angle such as 26*o*, as defined between the bottom such as 26*b* and the rear such as 26*d*, in order to give an upwardly, rear inclination to the stiles.

In a preferred embodiment, each of the brackets are fastened to the frame, extending thereabove and have each, a pivot such as 22*p*, 26*p*.

Each of the pivots for the stiles are in space relation to the frame and receive the front bottom of the stiles such as the front of bottom 26*b*, whereby the stiles rotate from a substantially horizontal to an inclined rear position, being stopped in the horizontal position by the frame 12 and in the inclined position by the flat bottom such as 26*b*, of the stiles resting against the frame 12.

Preferably the stiles have, near their respective bottom end, a frontward extension, such as 26*ce*, gradually increasing toward their respective bottom such as 26*b*, and the pivot for each of said stiles, such as 26*p*, being mounted on such a frontward extension.

Instead of brackets, such as 22*e*, mounted on the top of the beams, the front legs, such as 22, and the stiles, such as 26, may be mounted along the inner sides of the beams 12*a*, 12*b*, and stoppers may be provided on the beams, on the inner sides, wherein each of the pivots for the stiles are each respectively, in space relation to a stopper defined on the beams of the frame, for receiving the front bottom of a stile. The stiles rotate from a substantially horizontal to an upwardly, rear inclined, position, being stopped, in the rear inclined position, by the stoppers on the longitudinal beams. Thus the center of gravity of the chair or chairs is always falling rearwardly in order to obtain a stable equilibrium when in the rear inclined position, The chair 20 has a pair of side arms 32.34, each arm has one end such as 32*a* and another end such as 32*b* or 34*b*.

On one side of the chair, one side arm, such as 32, is at one end such as 32*a*, rotatably mounted near the top of one of the front legs such as 22*a*, and the one arm at the other end such as 32*b*, is rotatably mounted to the corresponding stile such as 28 on the same side, and on the other side of the chair, similarly, the other arm 34 is at one end rotatably mounted to the top of the other front leg, such as 24, and the other arm at the other end, is rotatably mounted to the other stile 26.

A back 38 is bridging the stiles, this back may be a continuous back or discontinuous with a top rail and one or several additional rails.

A seat 40 is mounted on a pair of opposite side-frames, respectively 42, 44.

Each of the side frames for the seat 40, has one end,such as 42*a*, and opposite thereto, another end, such as 42*b* of the side frame 42.

One of the side frames 42, 44, at the one end such as 42*a* is rotatably mounted to one of the stiles, such as 28, below the side arm, such as 32, and similarly, the other side frame 44, at the one end is rotatably mounted to the other stile 26 below said other side arm 34;

and the side frames near their other end, have, each respectively, a releasable holding means for holding the side frames 42, 44 of the seat, near that other end, to their corresponding leg 22, 24, for a suitable positioning of the seat, when in that upwardly, rear inclined position.

One such releasable holding means for holding one side frame of the seat, consists in providing the side frames with a slot such as 44*c* and at least one notch thereon such as 44*d*, for suitable inclination or positioning of the seat: (Better shown in FIG. 6, at 242*c* and 242*d*). Correspondingly each leg 22, 24 has respectively a projecting piece such as 24*g*, in space relation to one of the slots, in order to enable sliding of one of the slots along one of the projecting pieces, and be releasably held in one of the notches, of their respective slots. The projecting pieces, such as 24*g*, preferably consists in single continuous rod bridging the two legs.

Figure 6:
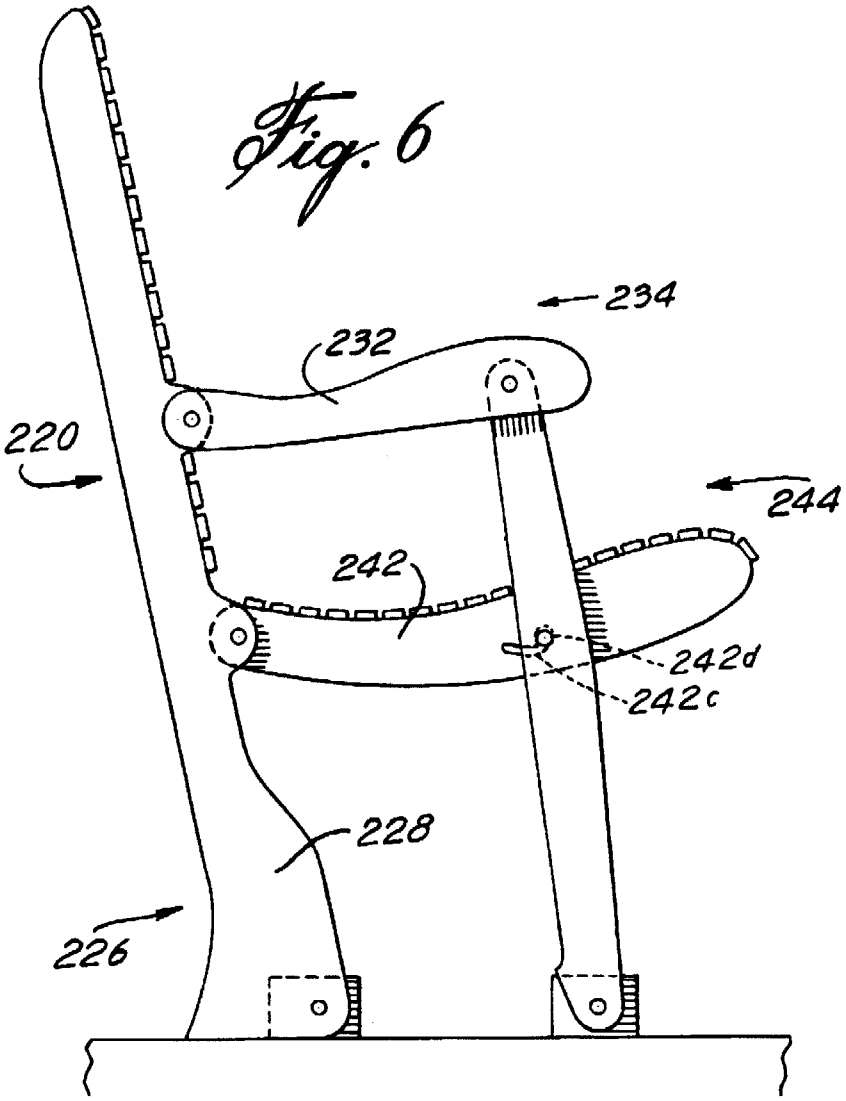
FIG. 6 is a side view of a chair illustrating another way of mounting a front leg and a stile.

As shown for chair 20, in a preferred embodiment, the side arms such as 32, 34 , as well as the side frames 42,44, of the seat are L-shaped, but need not be. Instead, if desired, as shown in FIG. 6, the chair 220 has straight side arms, for instance 232, 234, and side frames, for instance 242, 244, but in this instance, the stiles 226, 228 are provided with an outward frontward projection on which is rotatably mounted the side arms 232, 234, and the side frames 242, 244.

Thus, each chair is quickly foldable by releasing the releasable holding means for holding the side frames of the seat, and frontwardly bringing down the stiles, as shown In FIG. 2, from an upwardly, rear inclined, position, to a substantially horizontal position, and thereby the pair of front legs, the seat, and the pair of side arms, (One of the pair of front legs, the seat and the pair of side arms resting against the beams of the frame, in a preferred embodiment.)

and vice versa each chair, wether 20, 120 or 220, is being erected by lifting up the stiles until their respective flat bottom, rest against the stoppers on the longitudinal beams or other parallel sides as the case may be, and the stiles reach that upwardly, rear inclined, position, and the seat is locked by actuating the releasable holding means, the chair defining on each side, a parallelogram, such as with 24, 34, 26 and a space at the bottom between 24 and 26: with one of the front legs, one of the stiles, one of the side arms, and the space on the frame, as defined between said one of said front legs and said one of said stiles, the parallelogram on each side being bridged by the back. Thus when a chair is folded, the angles on each parallelogram are simultaneously changing.

In a preferred embodiment, two chairs are provided, such as 20 and 120: a chair is positioned near each of the opposite lateral beams 12*c*, 12*d* of the frame, as to be face-to-face, and the length of the stiles are less than half the length of the longitudinal beams of the frame, half of the length of a longitudinal beam of the frame determining the middle of the frame, and the stiles are positioned so that on folding, they stop short of the middle of the frame.

If desired, only one chair is positioned near one of the opposite lateral beams of the frame, as to be face-to-face, and facing the to and fro swing of the frame in such an instance, the length of the stiles are less than the length of one of the longitudinal beams of the frame, and the stiles are preferably positioned so that when the chair is folded, it does not exceed beyond the lateral beams of the frame.

Figure 3:
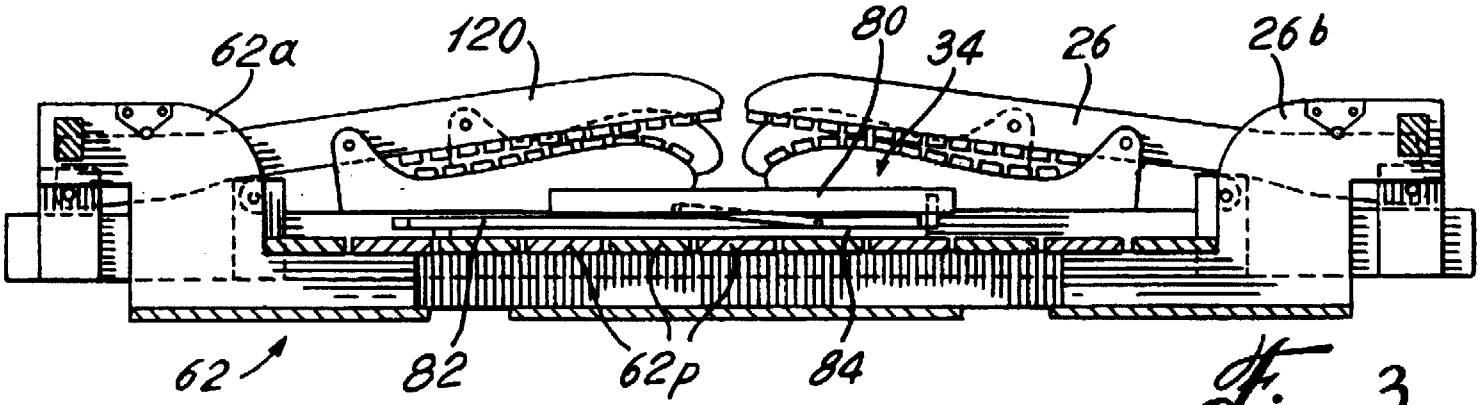
FIG. 3 is a vertical cross-section view of part of FIG. 2, but with the chairs and the table folded.

In FIGS. 1, 2 and 3, the means to sway to and fro that frame consists in a stator 62 circumscribed within the frame 12 between the longitudinal and lateral beams 12*a*, 12*b*, 12*c* and 12*d*, and short thereof, the stator 62 having a central foot platform 62*p*, and an upwardly projected support 62*a* 62*b*, under each chair, and joining the central platform 62*p*, each support, 62*a*, 62*b*, has rotatably mounted thereon, a crankshaft, 50,52 each having one double crank, such as 50*a*, 50*b* of crankshaft 50, (FIG. 7)

the ends of one crankshaft being rotatably mounted to the longitudinal beams 12*a*, 12*b*, under one of said chairs, and the other crankshaft being rotatably mounted to the longitudinal beams under the other chair: Each of the crankshafts is rotatably mounted with bushings such as 58, 60 to the frame 12, and 54, 56 to the stator frame 62, acting as a fulcrum above the frame 12.

The upper extensions 62*a*, 62*b*, are preferably positioned under the chairs 20 and 120,where a portion of the frame is easily cut off under these chairs, without any danger of falling in the cut-off portions, and the mechanism for floating the swing chair is hidden by the chairs for security sake. Most important, that mechanism further assists in obtaining a more compact swinging chair.

Other means may be used to suspend or hang the frame on fulcrums or fulcra above that frame, for the frame to be in a substantially horizontal position, If desired, as shown in FIGS. 7 and 8, one of the crank shafts may also be coupled to a motor 65 operating a cam 64 via arm 66 fixedly mounted to one of the crankshafts such as 50, and rotatably mounted to a follower arm 68 of the cam 64. The motor 65 and the cam 64 are held by a bracket 63.

The crankshaft may be longer, such that the bushings 54,56 are mounted under the frame 12, and 58, 60 above that frame 12 to a stator frame along the longitudinal beams of the frame, and similarly for the other crankshaft. Thus the stator surrounds the frame 12.

Other means which are known to sway to and fro such a frame may be used instead.

For instance, other means to suspend or hang the frame, may be used as long as the frame is below the fulcrums of the stator frame. By "stator frame" is meant which is the fix part of the swing chair.

Figure 10:
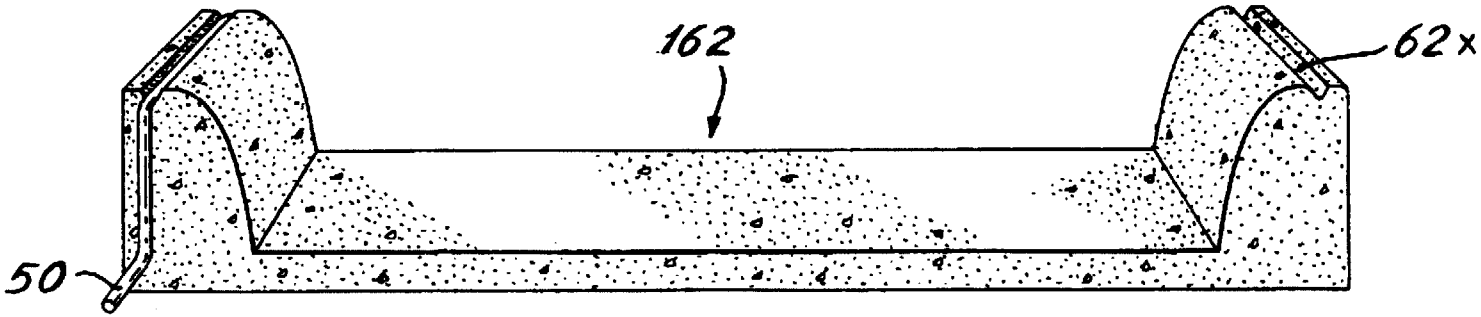
FIG. 10 is a side view of a stator on which a swing chair may be removably mounted.

The stator may simply be two separate supports, for instance a pair of Y-shaped metallic supports, or concrete as shown in FIG. 10, at 162, permanently or temporary set on the ground, of a park or landscape, for instance: for storage, the swing chair may be removably mounted on the crankshafts 50,52, leaving the crankshafts either with the swing chair, for instance as shown in FIG. 10 at 162*x*, or with the stator as shown at 50.

The stator 62 may for instance be a rectangular frame surrounding the frame 12, but spaced therefrom, having an upper extension on each longitudinal side of the frame, such as 62*a*, and 62*b*, as to form two pair of extensions, each extension being provided with means such as 62*g* for receiving bushings 58, 60 which would be in an upper position, and the lower portion becoming 50*c* of the crankshafts, and the rectangular frame of the stator and the frame 12 being provided with means to hold the bushings 58,60, 54,56: For instance by providing along the longitudinal beams brackets or frames, with slots for receiving the bushings.

Figure 9:
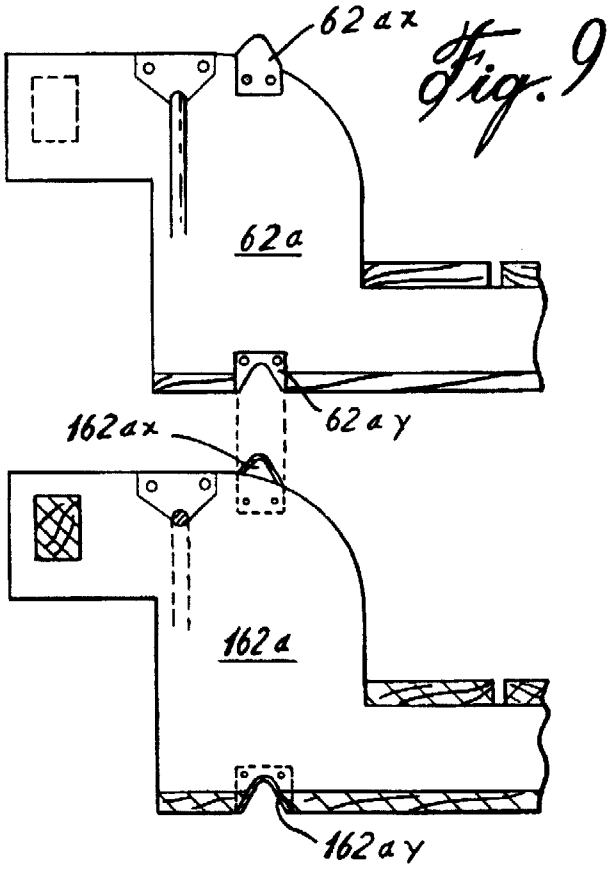
FIG. 9 is a side fragment view of a preferred stator having means for stacking swinging chairs one over the other.

When the stator is an integral part of a swing chair, in order to easily stack the chairs with their respective stator, the upwardly projected supports, such as 62*a*,62*b*, are provided with tongue and groove or male female engagements, such as for instance, 62*ax*, 62*ay*, 162*ax*, 162*ay*, and the like as shown in FIG. 9.

In a preferred embodiment, as shown in FIGS. 1 to 5, the frame is provided with a compact add-on table, releasably mounted on the frame 12. The foldable table releasably mounted on the frame 12 between the chairs, comprises:

a L-shaped panel 80 having a flat top surface 80*a*, a bottom surface 80*b*, a side bearing a short downward extension 80*c* and an opposite side 80*d*, a long leg panel 82 having a length "1", and being releasably held to said L-shaped panel, at the bottom surface near said opposite side, for maintaining said long leg perpendicular to said flat top surface of said L-shaped panel, a short leg panel 84 having a length being substantially that "1" of the long leg panel 82, minus the length of the downward extension of the L-shaped panel, 80*c*.

Figure 4:
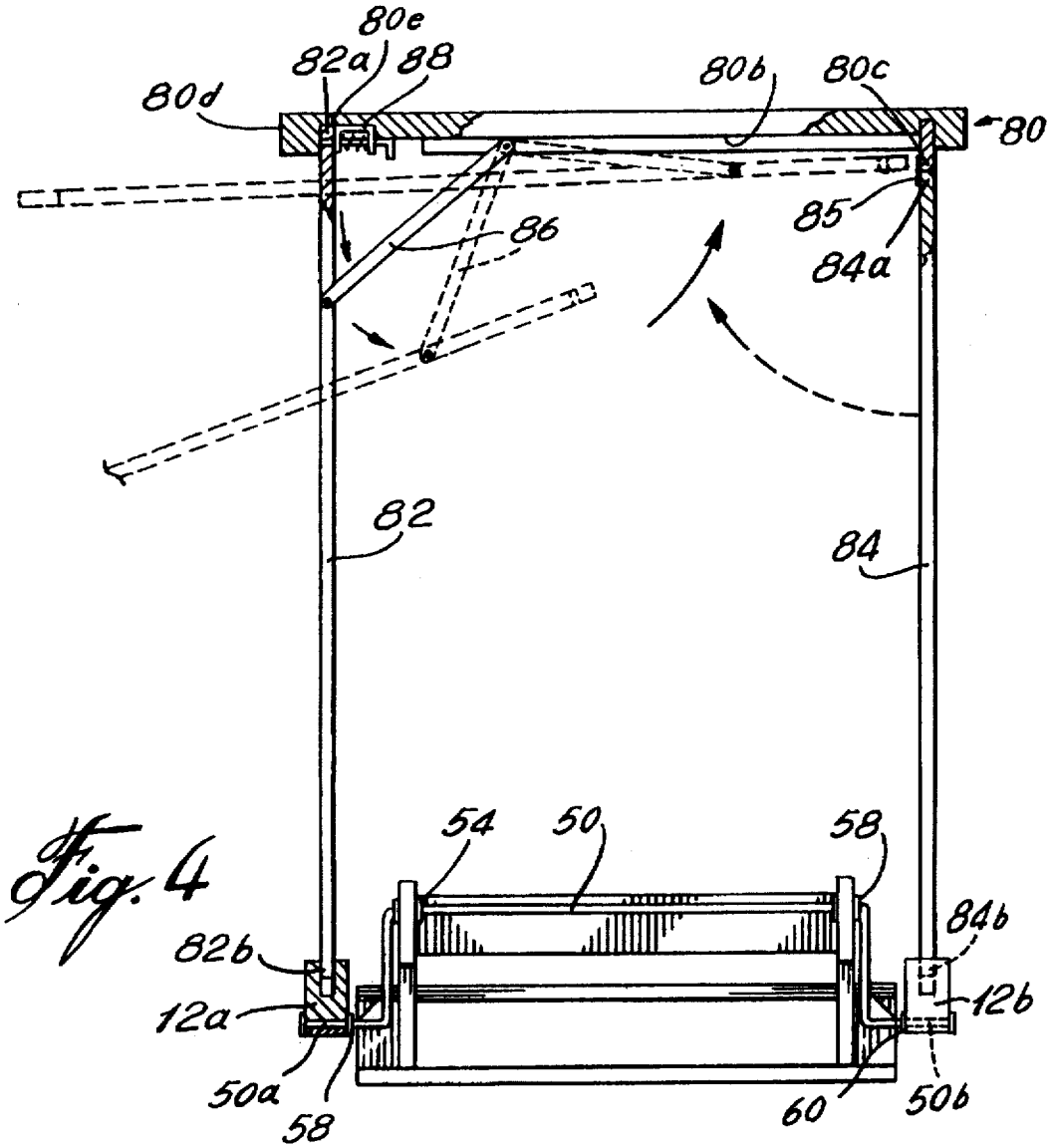
FIG. 4 is a cross-section view taken along line 4—4 of FIG. 1, with cut-out portions in order to ease understanding.

Preferably, the distance between the long leg panel 82, and the short leg panel 84 is substantially the distance between the symmetrical axis of longitudinal beam 12*a*, and 12*b* of the frame 12, a shown in FIG. 4, the long leg panel and the short leg panel having each respectively a top end 82*a*, 84*a*, and a bottom end, 82*b*, 84*b* and the top end 84*a* of the short leg panel, being hinged with a hinge 85, to the end of the short downward extension 80*c* of the L-shaped panel, for alternately maintaining said short leg panel perpendicular to said flat top surface of said L-shaped panel, and parallel to said flat top surface of said L-shaped panel.

The bottom surface of the L-shaped panel, near the side 80*d* opposite the short downward extension 80*c*, is provided with a slot 80*e*, snugly fitting the top end 82*a* of the long leg panel, for sliding into the slot, the top end of the long leg panel, a positioning link bar 86 is rotatably mounted at one end, to the long leg panel, and at the other end, to the L-shaped panel, for releasably mounting the top end of the long leg panel, into the slot, and alternately removing the top end of the long leg panel, thereby positioning the long leg panel substantially perpendicular to the flat bottom surface of the L-shaped panel, and alternately against the bottom surface, the L-shaped panel having a means to releasably hold the long leg panel into the slot, which may be for instance a spring-loaded rod 88 mounted on the L-shaped panel engaging a passage provided therefor in the top end 82*a* of the long leg panel.

The longitudinal beams 12*a*, 12*b* are provided with slots for receiving each one respectively of said bottom ends of said long and short leg panels, thereby releasably holding said legs onto the longitudinal beams, whereby upon releasing said means to releasably hold said long leg panel into said slot, said long leg panel is first foldable over the bottom surface of said L-shaped panel, and then the short leg panel is foldable over the long leg panel.

The legs may be provided with other releasable means of holding or fastening them to the frame near the longitudinal beams of the frame.

The table being so folded is thus positionable on the frame between the chairs.

In a preferred embodiment, the long panel 82 has a length stopping short of the length between the short downward extension of the L-shaped panel 80*c*, and the opposite side 80*d*, the short leg panel 84 having a length being substantially that of the long leg panel 82, minus the length of the downward extension of the L-shaped panel, 80*c*.

In another preferred embodiment, the length of the short downward extension is about the thickness of the long leg panel and the thickness of the short leg panel.

Figure 5:
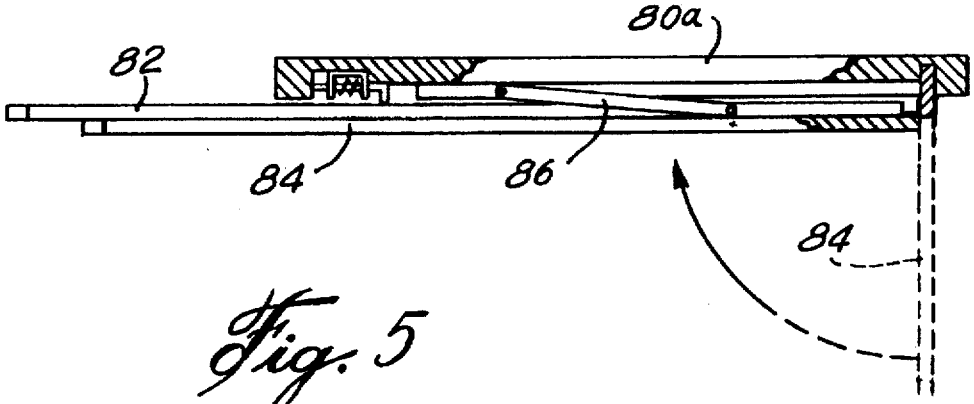
FIG. 5 is a view of the table as shown in the upper portion of FIG. 4, but folded for storage.

This table is foldably set, as shown in FIG. 5, and layed over the floor 62*p*, the chairs being bent over the table; this is possible because below the seats, the chairs have no other cross-bars bridging the two front legs such as 22, 24, than the continuous rod 22*g*, bridging the two legs, and thereby allowing free space between the frame and the seat.

If desired as shown in FIGS. 1 and 2, the quickly-foldable swing chair may be provided along the longitudinal beams 12*a*, 12*b*, of the frame 12, near each lateral beam, with an up rising rotatably mounted tubular arm, such as 94, 96, 98 and 99, each being provided with a slot such, as 96*a*, and retaining pivot such as 95. Thus the tubular arms may be turned and slide to engage a male or female, such as 93 fixed to the frame 12. Instead, if desired, other means to releasably hold the one end of the stiles, may be used.

On each of the lateral sides one of the tubular arms for instance 96 terminating with a ball jointed link bar 97, the link bar or linking member 97 at its free end being interlockable with the tubular arm 98, and bridging arms 96, to 98 for supporting a hammock 91. These tubular arms 98 and 99 are provided with a slot such as 98*a*.

Two U-shaped hammock supports are thus provided, each of said U-shaped hammock supports defining a pair of opposite hammock stiles: such as 96, 98 and a linking member such as 97 bridging said hammock stiles, and similarly for stiles 94,99.

As shown in FIGS. 1 and 2, each of said hammock stiles, have one end and an opposite end, and one end of the hammock stiles have a slot extending away from the one end and stopping short thereof.

One end of one of said hammock stiles of one of the U-shaped hammock supports,is rotatably mounted with a retaining pivot through the slot of said hammock stile, sideways along one of the longitudinal beams of said frame near one said lateral beams, and one end of the other hammock stile of said one of the U-shaped hammock supports, being rotatably mounted with another retaining pivot through the slot of said other hammock stile sideways along the other longitudinal side of said frame near said one of said lateral sides, for said hammock stiles of one of said U-shaped hammock supports to rotate from a horizontal position adjacent to, and sideways along one of the longitudinal beams to an upwardly, rear inclined position toward one of said lateral beams.

The other end of said hammock stiles have means for releasably mounting said linking member for bridging together said other ends of said two hammock stiles,in order to define one of said U-shaped hammock supports, and a means to releasably hold said one end of said hammock stiles of one of said U-shaped hammock supports, in space relation to said one end of one of said hammock stiles and said one end of the other hammock stile of one of said U-shaped hammock supports, when said hammock stiles are in said upwardly, rear inclined position, to releasably hold said one end of said hammock stiles.

Similarly one end of one hammock stile of the other U-shaped hammock support is rotatably mounted with a retaining pivot through the slot of said hammock stile, sideways along one of the longitudinal beams of said frame near the other lateral side, and one end of the other hammock stile of the other U-shaped hammock support being rotatably mounted with another retaining pivot through the slot of said other hammock stile 'sideways along the other longitudinal side of said frame near said other lateral side for said stiles of the other U-shaped hammock support to rotate from a horizontal position adjacent to, and sideways along one of the longitudinal beams to an upwardly, rear inclined position toward one of said lateral beams, and the other end of said hammock stiles having means for releasably mounting a linking member for bridging together said other ends of said two stiles, in order to define the other U-shaped hammock support, and a means to releasably hold said one end of said hammock stiles of the other U-shaped hammock support, in space relation respectively to said one end of one of said hammock stiles and respectively to said one end of the other stile of said other U-shaped hammock support, when said stiles are in said upwardly, rear inclined position, to releasably hold said one end of said stiles.

The linking members have a length, as defined between said hammock stiles, being longer than the length of the lateral beams of said frame, said hammock stiles being shorter than half the length of said longitudinal beams of said frame.

While some of the preferred embodiments have been described herein above, it is to be understood that the invention is not to be construed as limited to these preferred embodiments, as many modifications and variations are possible within the spirit and scope of the appended claims.

I claim:

1. In a quickly-foldable swing chair, the improvement comprising:

a frame having a pair of parallel sides, spaced one from the other, and said sides of the frame having mounted thereon, at least one chair, each of said chairs defining opposite sides, and having:

a pair of front legs and a pair of rear stiles, each front leg and each stile individually defining a top end and a bottom end opposite thereto, and a front and a rear opposite thereto, and each individually being pivotally mounted about a pivot mounted onto one of said parallel sides, each of said stiles defining a flat bottom end having an obtuse angle, as defined between said bottom end and said rear of a stile, a stopper defined on said parallel sides of said frame, each of said pivots for said stiles receiving a stile, adjacent to said front of said a stile and to said bottom end of said a stile, whereby said stiles rotate from a substantially horizontal to an upwardly, rear inclined, position, being stopped, in said rear inclined position, by said stoppers on said parallel sides of said frame, thus the center of gravity of said chair falling rearwardly in order to obtain a stable equilibrium when in said rear inclined position, a pair of side arms, each arm having one end and another end:

on one of said opposite sides of said chair, one of said side arms being at one end rotatably mounted to one front leg of said pair of front legs, near said top end of said one front leg of said pair of front legs, and said one of said side arms at said another end being rotatably mounted to one stile of said pair of stiles corresponding on the same side of the chair, and on the other of said opposite sides of said chair, the other side arm of said pair of side arms being at one end rotatably mounted to said top end of the other front leg, and said other side arm of said pair of side arms, at said another end, being rotatably mounted to the other stile;

a back bridging said stiles, a seat mounted on a pair of opposite side frames:

each of said side frames for said seat, having one end and opposite thereto, another end, one of said side frames, at said one end, being rotatably mounted to one of said stiles, below said one side arm, and the other side frame at said one end being rotatably mounted to the other of said stiles below said other side arm, and a releasable holding means for holding said side frames of the seat, near said another end, to their corresponding front legs, for a suitable positioning of the seat, when in said upwardly, rear inclined position, whereby said chair is quickly foldable by releasing said releasable holding means for holding said side frames of the seat, and frontwardly bringing down the stiles, from said upwardly, rear inclined, position, to a substantially horizontal position, and thereby said pair of front legs, said seat, and said pair of side arms, and vice versa, said chair is erected by lifting up said stiles until for each of said stiles defining a flat bottom end, their flat bottom end rests against one of said stoppers defined on said parallel sides of said frame, and the stiles reach said upwardly, rear inclined, position, and the seat is locked by actuating said releasable holding means, on each of said opposite sides of said chair, a parallelogram being defined with one of said front legs, one of said stiles, one of said side arms, and the space on said frame as defined between said one of said front legs and said one of said stiles, said back bridging said stiles, thus bridging the parallelogram on each of said opposite sides of said chair, upon folding of the chair, the angles on said parallelograms changing, and correspondingly those of the front legs, and of the stiles with the side frames defining said parallelograms.

2. In a quickly-foldable swing chair, as defined in claim 1, wherein said frame is a rectangular frame having longitudinal and lateral beams jointly mounted as to define a rectangle, said beams defining a top, and said longitudinal beams of the frame, having mounted thereon, at least one chair, and wherein said front legs and said pair of rear stiles, each individually is pivotally mounted onto said longitudinal beams, via a bracket.

3. The quickly-foldable swing chair as defined in claim 1, wherein the stiles have, near their respective bottom end, frontward extension gradually increasing toward said respective bottom end, and said pivot for each of said stiles is received on such a frontward extension.

4. The quickly-foldable swing chair as defined in claim 1, wherein the stiles have, near their respective bottom end, a frontward extension gradually increasing toward said respective bottom end, and said pivot for each of said stiles is received on such a frontward extension, said side arms are L-shaped, and said side frames of the seat are also L-shaped.

5. The quickly-foldable swing chair as defined in claim 1, wherein said side arms are L-shaped, and said side frames of the seat are also L-shaped.

6. A quickly-foldable swing chair comprising:

in a frame having a means to sway to and fro said frame, said frame having opposite longitudinal beams, and lateral opposite beams there across the longitudinal beams and jointly mounted thereto, said longitudinal beams of the frame having a length, and a top, said longitudinal beams of the frame, having mounted thereon, at least one chair, each of said chairs defining opposite sides, and having:

a pair of front legs and a pair of rear stiles, each front leg and each stile individually defining a top end and a bottom end opposite thereto, and a front and a rear opposite thereto, and at their respective bottom end, each individually being pivotally mounted on a bracket, each of said stiles defining a flat bottom end having an obtuse angle as defined between said bottom end and said rear of a stile, said brackets being fastened to said longitudinal beams of said frame, extending thereabove, and having a pivot, each of said pivots for said stiles receiving one of said stiles, adjacent to said front of said one of said stiles and to said bottom end of said one of said stiles, whereby said stiles rotate from a substantially horizontal to an upwardly, rear inclined position, being stopped by said frame, and in the inclined position by said flat bottom end of said stiles resting against the longitudinal beams of said frame, a pair of side arms, each arm having one end and another end:

on one of said opposite sides of said chair, one of said side arms being at one end rotatably mounted to one front leg of said pair of front legs, near said top end of said one front leg of said pair of front legs, and said one of said side arms at said another end being rotatably mounted to one stile of said pair of stiles corresponding on the same side of the chair, and on the other of said opposite sides of said chair, the other side arm of said pair of side arms being at one end rotatably mounted to said top end of the other front leg, and said other side arm of said pair of side arms, at said another end, being rotatably mounted to the other stile;

a back bridging said stiles, a seat mounted on a pair of opposite side frames:

each of said side frames having one end, and opposite thereto, another end, one of said side frames at said one end being rotatably mounted to one of said stiles, below said one side arm, and the other side frame at said one end, being rotatably mounted to the other of said stiles below said other side arm, and said side frames, near said another end, having each respectively, a slot and at least one notch thereon, for suitable positioning of the seat, and correspondingly each of said front legs having respectively a projecting piece in space relation to one of said slots, in order to enable sliding of one of said slots, along one of said projecting pieces, and be releasably held in one of said at least one notch, of their respective slots, whereby said chair is foldable by releasing said projecting pieces from said notches, and frontwardly bringing down, from an upwardly, rear inclined position of the stiles, to a substantially horizontal position, laying down the front legs against said longitudinal beams of said frame, the seat against the front legs, and the stiles against said seat, and vice versa said chair being erected by lifting up said stiles until their respective flat bottom ends, rest against said longitudinal beams of said frame, and the stiles reaching said upwardly, rear inclined position, and the seat is locked with said projection pieces in said notches, on each of said opposite sides of said chair, a parallelogram being defined with one of said front legs, one of said stiles, one of said side arms, and the space on said longitudinal beams of said frame as defined between said one of said front legs and said one of said stiles, said back bridging said stiles thus bridging the parallelogram on each of said opposite sides of said chair, upon folding of the chair, the angles on said parallelograms changing, and correspondingly those of the front legs, and of the stiles with the side frames defining said parallelograms.

7. The quickly-foldable swing chair as defined in claim 6, wherein the stiles have, near their respective bottom end, a frontward extension gradually increasing toward said respective bottom end, and said pivot for each of said stiles is mounted on such a frontward extension.

8. The quickly-foldable swing chair as defined in claim 6, wherein the stiles have, near their respective bottom end, a frontward extension gradually increasing toward said respective bottom end, and said pivot for each of said stiles is mounted on such a frontward extension, said side arms are L-shaped, and said side frames of the seat are also L-shaped, and the short ends of said L-shapes are mounted to said stiles.

9. The quickly-foldable swing chair as defined in claim 6, wherein said projecting pieces of said pair of front legs define a continuous rod bridging said pair of front legs.

10. The quickly-foldable swing chair as defined in claim 6, wherein the to and fro swing of said frame is along said longitudinal beams of said frame, and one chair is positioned near one of said opposite lateral beams of said frame, as to be facing the to and fro swing of said frame, and wherein the length of said stiles are less than the length of said longitudinal beams of said frame, and the stiles are positioned so that the folded chair does not exceed beyond the lateral beams of the frame.

11. The quickly-foldable swing chair as defined in claim 6, which further includes a foldable table positionable on said frame between said chairs, said foldable table comprising:

a L-shaped panel, said L-shaped panel having:

a flat top surface, a bottom surface, a side, and an opposite side, said a side bearing a short downward extension, a long leg panel having a given length, and being releasably held to said L-shaped panel, at said bottom surface of said L-shaped panel, near said opposite side of said L-shaped panel, for maintaining said long leg panel perpendicular to said flat top surface of said L-shaped panel, a short leg panel having a length being substantially that of the given length of the long leg panel, minus the length of the downward extension of said L-shaped panel, and said short leg panel being hinged to the short downward extension of the L-shaped panel, for alternately maintaining said short leg panel perpendicular to said flat top surface of said L-shaped panel, and parallel to said flat top surface of said L-shaped panel, and said long leg panel upon being released from said L-shaped panel, being foldable against said bottom surface of said L-shaped panel, and said leg panels being provided with means to releasably hold them to said frame, on said longitudinal beams of said frame, said long leg panel and said short leg panel having each respectively a given thickness, and the thickness of said leg panels corresponding substantially to said length of the downward extension of said L-shaped panel, whereby upon releasing said leg panels from said frame, and said long leg panel from said L-shaped panel, said long leg panel is first foldable over the bottom surface of said L-shaped panel, and then the short leg panel is foldable over said long leg panel.

12. The quickly-foldable swing chair as defined in claim 6, wherein midway of said length of said longitudinal beams of the frame, said frame defines the middle of the frame, and two chairs are provided:

a chair is positioned near each of said opposite lateral beams of said frame, as to be face-to-face, the length of the stiles are less than half the length of the longitudinal beams of the frame, and the stiles are positioned so that on folding, they stop short of said middle of the frame.

13. The quickly-foldable swing chair as defined in claim 12, which further includes a foldable table releasably mounted on said frame between said chairs, said foldable table comprising:

a L-shaped panel having a flat top surface, a bottom surface, a side bearing a short downward extension, and a side opposite said side bearing said a short downward extension, a long leg panel having a given length, a short leg panel having a length being substantially that of the long leg panel minus the length of the downward extension of said L-shaped panel, said long leg panel and said short leg panel having each respectively a top end and a bottom end, and said top end of said short leg panel, being hinged to the end of said short downward extension of the L-shaped panel, for alternately maintaining said short leg panel perpendicular to said flat top surface of said L-shaped panel, and parallel to said flat top surface of said L-shaped panel, said bottom surface of said L-shaped panel, near said side opposite to said side bearing said a short downward extension, being provided with a slot, snugly fitting said top end of said long leg panel, for sliding into said slot, said top end of said long leg panel, a positioning link bar rotatably mounted at one end, to said long leg panel, and at the other end, to said L-shaped panel, for releasably mounting said top end of said long leg panel, into said slot, and alternately removing said top end of said long leg panel, thereby positioning said long leg panel substantially perpendicular to said flat bottom surface of said L-shaped panel, and alternately against said bottom surface, said L-shaped panel having a means to releasably hold said long leg panel into said slot, and said longitudinal beams being provided with slots for receiving said bottom end of said long and short leg panels, whereby upon releasing said means to releasably hold said long leg panel into said slot, said long leg panel is first foldable over the bottom surface of said L-shaped panel, and then the short leg panel is foldable over said long leg panel.

14. The quickly-foldable swing chair as defined in claim 13, wherein said longitudinal beams have each respectively a longitudinal symmetrical axis, and the distance between the long leg panel and the short leg panel is substantially the distance between the symmetrical axis of the longitudinal beams.

15. The quickly-foldable swing chair as defined in claim 13, wherein the length of said short downward extension of said L-shaped panel, is about the thickness of said long leg panel plus the thickness of said short leg panel.

16. The quickly-foldable swing chair as defined in claim 6, which includes two U-shaped hammock supports, each of said U-shaped hammock supports defining a pair of opposite hammock stiles and a linking member bridging said hammock stiles, each of said hammock stiles, having one end and an opposite end, said one end of said hammock stiles having a slot extending away from said one end and stopping short thereof, one end of one of said hammock stiles of one of the U-shaped hammock supports being rotatably mounted with a retaining pivot through the slot of said hammock stile, sideways along one of the longitudinal beams of said frame near one of said lateral beams, and one end of the other hammock stile of said one of the U-shaped hammock supports, being rotatably mounted with another retaining pivot through the slot of said other hammock stile sideways along the other longitudinal side of said frame near said one of said lateral sides, for said hammock stiles of one of said U-shaped hammock supports to rotate from a horizontal position adjacent to, and sideways along one of the longitudinal beams to an upwardly, rear inclined position toward one of said lateral beams, and the other end of said hammock stiles having means for releasably mounting said linking member for bridging together said other ends of said two hammock stiles,in order to define one of said U-shaped hammock supports, and a means to releasably hold said one end of said hammock stiles of one of said U-shaped hammock supports, and said one end of the other hammock stile of one of said U-shaped hammock supports, when said hammock stiles are in said upwardly, rear inclined position, and one end of one hammock stile of the other U-shaped hammock support being rotatably mounted with a retaining pivot through the slot of said hammock stile, sideways along one of the longitudinal beams of said frame near the other lateral side, and one end of the other hammock stile of the other U-shaped hammock support being rotatably mounted with another retaining pivot through the slot of said other hammock stile sideways along the other longitudinal side of said frame near said other lateral side for said stiles of the other U-shaped hammock support to rotate from a horizontal position adjacent to, and sideways along one of the longitudinal beams to an upwardly, rear inclined position toward one of said lateral beams, and the other end of said hammock stiles having means for releasably mounting a linking member for bridging together said other ends of said two stiles, in order to define the other U-shaped hammock support, and a means to releasably hold said one end of said hammock stiles of the other U-shaped hammock support, and said one end of the other stile of said other U-shaped hammock support, when said stiles are in said upwardly, rear inclined position, said linking member having a length, as defined between said hammock stiles, being longer than the length of the lateral beams of said frame, said hammock stiles being shorter than half the length of said longitudinal beams of said frame.

17. The quickly-foldable swing chair as defined in claim 16, wherein said means to releasably hold said one end of said stiles of said U-shaped hammock supports, is a tube for each of said one end, mounted on said longitudinal beams for receiving each respectively, one of said one end of said hammock stiles.

18. The quickly-foldable swing chair as defined in claim 6, wherein two chairs are provided:

a chair is positioned near each of said opposite lateral beams of said frame, as to be face-to-face, the length of the stiles are less than half the length of the longitudinal beams of the frame, half of said length of said frame defining the middle of the frame, the stiles are positioned so that on folding, they stop short of said middle of the frame, and said means to sway to and fro said frame consists in a stator circumscribed within said frame between said longitudinal and lateral beams and short thereof, said stator having a central foot platform, and an upwardly projected support under each of said chairs and joining said central platform, each of said supports having, rotatably mounted thereon, a crankshaft having one double crank, the ends of one of said crankshafts being rotatably mounted to said longitudinal beams under one of said chairs, and the other crankshaft being rotatably mounted to said longitudinal beams under the other chair.

19. The quickly-foldable swing chair as defined in claim 18, wherein the stator is an integral part of said swing chair, and the upwardly projected supports are provided with tongue and groove engagements, in order to easily stack the chairs with their respective stator.

* * * * *